United States Patent [19]

Gudmestad et al.

[11] Patent Number: 4,569,618

[45] Date of Patent: Feb. 11, 1986

[54] PROCEDURE FOR DRAINING OFF SHALLOW GAS FROM THE SEABED AND AN ARRANGEMENT FOR EXECUTION OF THE PROCEDURE

[75] Inventors: Ove T. Gudmestad, Naerboe; Martin T. Hovland, Sola, both of Norway

[73] Assignee: Den Norske Stats Oljeselskap A.S., Stavanger, Norway

[21] Appl. No.: 645,291

[22] Filed: Aug. 29, 1984

[30] Foreign Application Priority Data

Sep. 1, 1983 [NO] Norway ..... 833129

[51] Int. Cl.[4] ..... E02D 3/00; E02D 5/00

[52] U.S. Cl. ..... 405/258; 405/208; 405/227

[58] Field of Search ..... 405/5, 36, 43, 45, 50, 405/46, 44, 195, 207, 208, 210, 211, 229, 224, 226, 227, 228, 231, 253, 206, 258; 166/74, 369, 370

[56] References Cited

U.S. PATENT DOCUMENTS

| | | | |
|---|---|---|---|
| 106,709 | 8/1870 | McMillan | 405/43 |
| 483,697 | 10/1892 | Rich | 405/5 X |
| 1,688,356 | 10/1928 | Romney | 405/45 X |
| 2,895,301 | 7/1959 | Casagrande et al. | 405/208 |
| 2,938,354 | 5/1960 | Knapp | 405/206 |
| 3,330,120 | 7/1967 | Atkinson | 405/43 X |
| 3,833,071 | 9/1974 | Koosman et al. | 405/50 |
| 3,928,982 | 12/1975 | Lacroix | 405/210 X |
| 3,962,878 | 6/1976 | Hansen | 405/195 |
| 4,026,355 | 5/1977 | Johnson et al. | 166/369 X |
| 4,040,263 | 8/1977 | Eide et al. | 405/195 |
| 4,102,143 | 7/1978 | Phares et al. | 405/227 |
| 4,455,102 | 6/1984 | Juhola | 405/50 |
| 4,479,546 | 10/1984 | Bresie et al. | 166/369 |

FOREIGN PATENT DOCUMENTS

| | | | |
|---|---|---|---|
| 89620 | 7/1981 | Japan | 405/50 |
| 127822 | 7/1983 | Japan | 405/50 |

*Primary Examiner*—Cornelius J. Husar
*Assistant Examiner*—Nancy J. Stodola
*Attorney, Agent, or Firm*—Schwartz, Jeffery, Schwaab, Mack, Blumenthal & Evans

[57] ABSTRACT

The procedure for draining off shallow gas from the seabed and arrangement for execution of the procedure, whereby through the upper sedimentary layer is placed a system of vertical drainage piles (2) for gas around the site in question for location of a construction on the seabed or along a pipeline route on the seabed.

The arrangement includes principally a base plate (1) with a central hole for acceptance of a drainage pile (2) after the base plate (1) has been placed on the seabed.

8 Claims, 1 Drawing Figure

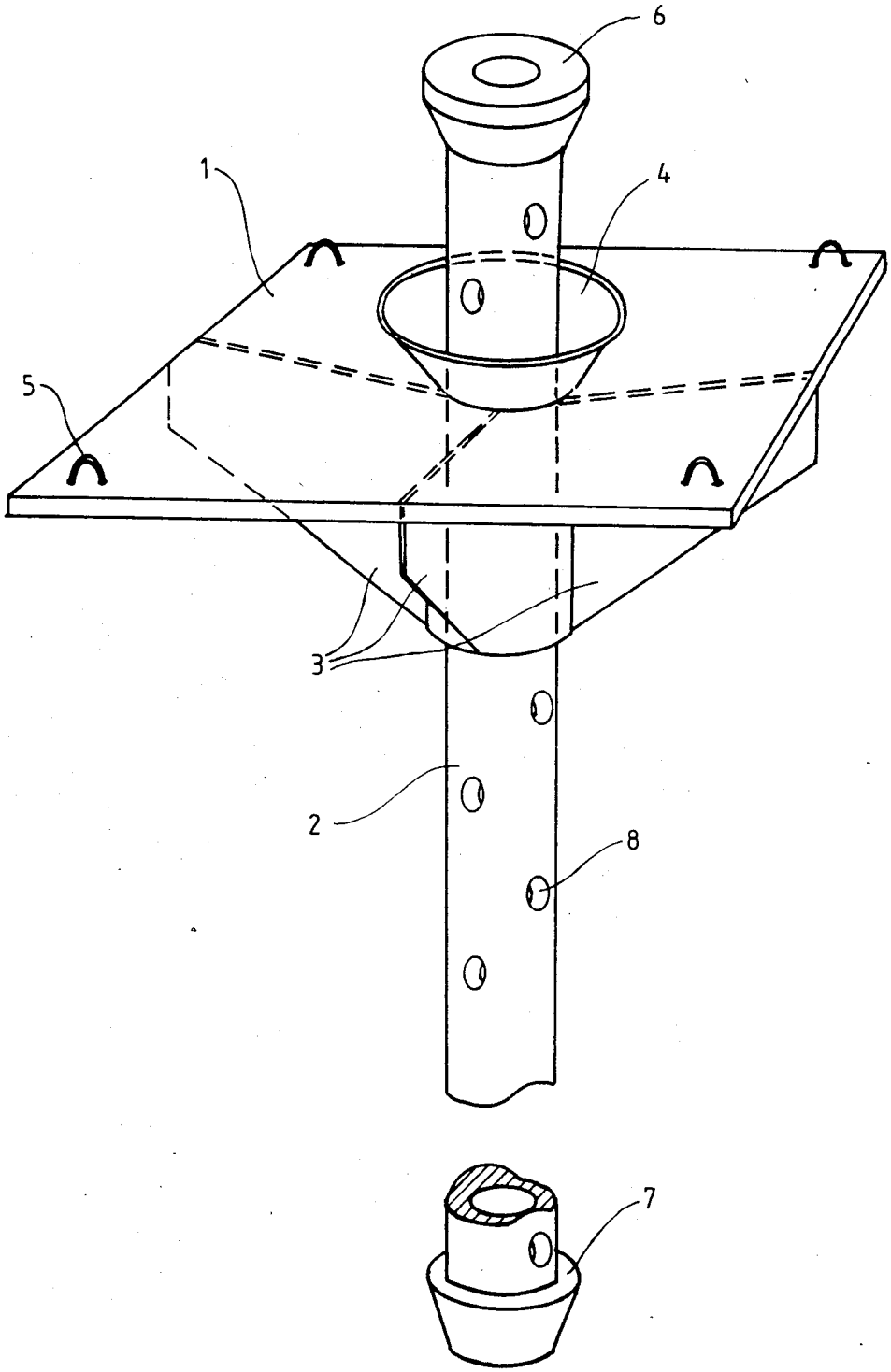
6
1
4
5
3
2
8
7

PROCEDURE FOR DRAINING OFF SHALLOW GAS FROM THE SEABED AND AN ARRANGEMENT FOR EXECUTION OF THE PROCEDURE

BACKGROUND

1. Field of the Invention

This invention concerns a procedure for draining off shallow gas from the seabed and an arrangement for execution of the procedure.

2. Prior Art

In areas of the North Sea and Gulf of Mexico there are strong indications that shallow gas in the upper sedimentary layers percolates upward to the seabed. In relation to construction and installation works on the seabed, pipelines, platforms etc., such areas can be called "active". If precautionary measures are not performed, such areas ought to be avoided with respect to construction and installation works.

In active areas where the upper sedimentary layer consists of soft, fine grained and clayey sediment, the natural gas migration is focused, and may burst through the upper layer in a random pattern. The focusing effect is caused by the semi-impermeability of the upper layer. In soft sediment, shallow depressions termed "pockmarks" are observed, and it is hypothesized that these are formed due to the migration process described above.

A seabed where "pockmarks" are found and where seismic surveys indicate that shallow gas exists in the upper sedimentary layers, may be called "active and instable". It is proposed that precautionary measures be executed in such areas prior to construction and installation works on the seabed. The objective of these precautions shall be to ensure that the area in question becomes inactive and stable, so that there exists no danger that shallow gas will percolate upward beneath the construction.

OBJECTS AND SUMMARY

The objective of the invention is to provide a procedure and arrangement for controlled draining of shallow gas from the seabed, so that the area of the seabed in question becomes inactive and stable.

The procedure of draining off shallow gas from the seabed and arrangement for execution of the procedure, whereby through the upper sedimentary layer is placed a system of vertical drainage piles for gas around the site in question for location of a construction on the seabed or along a pipeline route on the seabed.

The arrangement includes principally a base plate with a central hole for acceptance of a drainage pile after the base plate has been placed on the seabed.

BRIEF DESCRIPTION OF THE DRAWING

The invention, which is based on there being installed through the upper, partly impervious, soft and clayey sedimentary layer a system of draining piles for gas, will be explained in more detail in connection with the attached perspective drawing, which purely schematically and as an example shows an embodiment of an arrangement in accordance with the invention.

DETAILED DESCRIPTION OF THE INVENTION

On the drawing, reference number 1 refers to a base plate with a central hole for taking up a drainage pile 2 after the base plate 1 has been placed on the seabed where shallow gas is to be drained. The base plate 1 has the job of positioning and guiding the drainage pile 2 vertically into the seabed. Base plate 1 consists of a solid steel plate with dimensions adequate to prevent it sinking into the seabed. The dimensions will typically be 5 by 5 meters and approximately 25 mm thick. On the underside the base plate 1 has fins 3 which are arranged so as to sink into the seabed and stabilize the base plate 1 horizontally. Base plate 1 is also equipped with stiffeners (not shown) to prevent warping. On the upper side of the base plate 1 around the central hole there is attached a funnel 4 to guide the drainage pile 2 through the central hole in the base plate 1 upon placement into the seabed. At the corners of the base plate 1 are provided attachments 5 for lifting hooks. Drainage pile 2 consists of a steel tube which is open at both ends, with the top end being formed with a head 6 for hammer installation, and the bottom, and possibly also further up, being formed with a conical shoulder 7 which facilitates the impregnation of the drainage pile 2 into the seabed, as the maximum diameter of the conical shoulder 7 is uppermost and is larger than the diameter of the drainage pile 2. Drainage pile 2 is further equipped with a series of radial holes 8 of approximately 50 mm diameter to increase the draining efficiency.

Upon installation the drainage pile 2 is lowered through the funel 4 and the hole in the base plate 1 down to the seabed and is hammered into this with the aid of an underwater hammer. The length of the drainage pile 2 is chosen so that drainage pile 2 can penetrate through the upper sedimentary layer and into the more uniform and more readily penetrable sediment layer which underlies the upper layer. In the North Sea a typical length for the drainage pile 2 will be 30–45 meters, and a maximum length of 60 meters is assumed. Regarding the outer diameter of the drainage pile 2, it is considered suitable for this to be 0.75–1.00 meters, and a wall thickness of 15–25 mm is assumed.

The drainage pile 2 will act as an artificial zone of weakness through the upper semi-impermeable sediment layer. Because the drainage pile 2 is open and equipped at the lower end, and possibly also higher up, with a conical shoulder 7, the drainage pile 2 will readily be able to be installed without the use of large underwater hammers.

We claim:

1. Apparatus for draining shallow gas from a seabed, comprising:

(a) a base plate having an upper side, an under side, and a hole therethrough;

(b) a drainage pile vertically movable in the hole;

(c) a plurality of fin means on the underside for penetrating into the seabed for horizontally stabilizing said base plate;

(d) a funnel member on the upper side of said base plate for guiding said drainage pile through the hole in said base plate;

(e) said drainage pile comprising a tube open at an uppermost end and a lowermost end;

(f) a head positioned at the uppermost end of said drainage pile for receiving a hammer blow and a conical shoulder at the lowermost end of said drainage pile; and (g) a plurality of radial holes in said drainage pile for increasing the draining effect.

2. A method of draining shallow, free gas from a seabed where an upper sedimentary layer is formed of active and instable soft, fine grained sediment and the like, comprising:

(a) placing a base plate with a hole therethrough onto the seabed at a location where the gas is to be drained;

(b) positioning a lower end of a drainage pile into the hole of said base plate;

(c) hammering an upper end of said drainage pile into the upper sedimentary layer; and (d) allowing the gas to drain upward through said drainage pile.

3. The method of claim 2, wherein said base plate has an upper side and a lower side and a funnel member on said upper side, guiding said drainage pile through said funnel member.

4. The method of claim 2 including positioning a head at the upper end of said drainage pile.

5. The method of claim 4 including placing a conical shoulder at a lowermost end of said drainage pile.

6. The method of claim 2 including placing a plurality of radial holes in said drainage pile for increasing the draining effect.

7. The method of claim 2 including providing a plurality of fin means on a lower side of said base plate, for positioning said base plate onto the seabed.

8. A method of draining shallow, free gas from a seabed where an upper sedimentary layer is formed of active and instable soft, fine grained sediment and the like, comprising:

(a) placing a base plate, having an upper side and a lower side with a hole therethrough, onto the seabed at a location where the gas is to be drained;

(b) providing a plurality of fin means on a lower side of said base plate, for positioning said base plate onto the seabed;

(c) providing a funnel member on said upper side for guiding a drainage pile having a plurality of radial holes through said funnel member;

(d) positioning a lower end of said drainage pile into the hole of said base plate;

(e) positioning a head at an upper end of said drainage pile;

(f) placing a conical shoulder at a lowermost end of said drainage pile;

(g) hammering said upper end of said drainage pile into the upper sedimentary layer; and (h) allowing the gas to drain upward through said drainage pile.

* * * * *